US006465047B1

(12) United States Patent
Scott et al.

(10) Patent No.: US 6,465,047 B1
(45) Date of Patent: Oct. 15, 2002

(54) PRECISION POLYMER DISPERSION APPLICATION BY AIRLESS SPRAY

(75) Inventors: Paul Scott, Epsom (GB); Andre Sol, Maastricht (NL)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 09/942,888

(22) Filed: Aug. 30, 2001

(51) Int. Cl.[7] ..... B05D 1/02
(52) U.S. Cl. ..... 427/421; 427/422
(58) Field of Search ..... 427/421, 422

(56) References Cited

U.S. PATENT DOCUMENTS

| | | | | |
|---|---|---|---|---|
| 4,515,836 A | | 5/1985 | Cobbs, Jr. et al. | 427/425 |
| 4,573,429 A | | 3/1986 | Cobbs, Jr. et al. | 118/322 |
| 5,009,367 A | * | 4/1991 | Nielsen | 427/422 |
| 5,057,734 A | * | 10/1991 | Hoy et al. | 427/422 |

FOREIGN PATENT DOCUMENTS

| | | | |
|---|---|---|---|
| EP | 507634 | * | 10/1992 |
| EP | 698644 | * | 2/1996 |
| JP | 04-090874 | * | 3/1992 |
| WO | WO 99/19081 | * | 4/1999 |
| WO | WO 01/56625 | * | 8/2001 |

* cited by examiner

*Primary Examiner*—Erma Cameron
(74) *Attorney, Agent, or Firm*—Thomas F. Roland, Esq.

(57) ABSTRACT

The present invention is directed to a method for applying an aqueous polymer dispersion to a substrate involving forming a viscosity of from 10 to 5,000 m·Pas, and applying the dispersion to a substrate at a pressure of from 100 to 1500 psi. The method is useful with porous substrates, and especially in non-woven materials. The process provides a precise means of coating a polymer dispersion on the surface of a substrate, or with controlled penetration into the substrate.

10 Claims, No Drawings

PRECISION POLYMER DISPERSION APPLICATION BY AIRLESS SPRAY

FIELD OF THE INVENTION

This invention relates to a method for applying a polymer dispersion in a precise manner to a substrate, through the use of airless spray technology. The method provides application flexibility for applying the polymer dispersion on the surface of a substrate, or with controlled penetration into the substrate. The method is particularly useful in applying a polymer dispersion to the surface of a porous substrate, and especially useful for applying a binder or a surface treatment to a non-woven substrate.

BACKGROUND OF THE INVENTION

Aqueous polymer dispersions can be applied to a substrate in many ways, including brushing, immersion (saturation), foaming, and spraying. Spray application is known in the industry as an efficient and high-speed means of applying liquid coatings to substrates.

Spray application of polymeric dispersions is used in the production of non-woven materials. The polymeric dispersions are used as binders to consolidate the base-sheet, used for control linting in Multi Bonded Airlaid (MBAL) materials, or used as surface treatments. Current spray processes used in the production of non-woven materials require that the polymer dispersion be diluted with water, making accurate control of binder distribution within a fiber matrix difficult. Typical spray bonding processes involve dilution of a polymer dispersion to between 10 and 35 percent non-volatile content in order to achieve satisfactory atomization. Application of polymer resin to the non-woven occurs using a spray boom, containing nozzles positioned across the web profile, which are fed from a sealed pressure vessel.

Current polymer spray systems work well for through fiber coating of the non-woven material, resulting in a coating of both the surface and core of the non-woven substrate. Current methods do not allow for surface application only, primarily due to the low viscosity of the diluted dispersion. For precision application, a higher solids dispersion must be used in order to minimize penetration of the substrate, and must be used in conjunction with a system that offers superior atomization of the wet dispersion. Current spray bonding is also prone to over-spray and line contamination.

U.S Pat. Nos. 4,515,836 and 5,573,429 describe the use of airless spray technology for the application of a coating to plastic bottles. In the described airless spray process, higher solids polymeric dispersion (typically from 40 to 60 percent) are applied to plastic bottles.

There is a need for a high-speed process for applying a polymer dispersion in a controlled manner onto, or into, a porous substrate, particularly in the non-wovens industry.

Surprisingly it has been found that polymer dispersions, having viscosities of between 10 and 5,000 m·Pas can be applied in a precise manner to porous substrates using an airless spray process. One advantage of the process is the ability to use commercial polymer dispersions without the need for dilution. Another advantage is that at the higher solids levels, the polymer dispersion can be applied to the surface only. This precise application of polymer leads to less polymer usage, and the higher solids dispersions require less time and energy to dry, thereby reducing manufacturing costs.

SUMMARY OF THE INVENTION

The present invention is directed to a method for applying an aqueous polymer dispersion to a substrate comprising:

a) forming a polymer dispersion having a viscosity of from 10 to 5,000 m·Pas;

b) applying said dispersion to a substrate by use of airless spray at a pressure of from 100 to 1500 psi.

DETAILED DESCRIPTION OF THE INVENTION

The present invention relates to a method for applying a polymer dispersion in a precise manner to a substrate, through the use of an airless spray.

An aqueous polymer dispersion, as used herein, refers to polymer particles dispersed in water. The dispersion may be formed by any means known in the art, such as emulsion polymerization, inverse emulsion polymerization, suspension polymerization, and the dispersion of polymer particles into water which are either self-dispersing, or are stabilized using colloid stabilizers, surfactants, or both. Natural polymers may be dispersed with or without the use of stabilizers and/or surfactants.

By airless spray, as used herein, is meant the application of an aqueous polymer dispersion to a substrate using hydraulic pressure instead of air to atomize and spray liquids. This technology involves forcing a polymer dispersion through a small, precise orifice at a pressure of from 100 to 1500 psi. This process results in the dispersion forming a fan pattern containing virtually no air turbulence, and thereby minimal overspray. The absence of air also reduces the droplet velocity, thereby minimizing the disturbance of the web.

Cross-cut nozzles, dome nozzles, and other types of nozzles can be used in the airless spray process. A cross-cut nozzle capable of providing precise fan patterns is preferred over standard airless nozzles. As a cross-cut nozzle wears, the fan pattern widens creating an acceptable problem of over-lapping coverage. As a standard nozzle wears the fan pattern narrows, creating unacceptable gaps between adjacent fan patterns.

The airless spray system ideally includes a high quality filtration system to minimize the risk of nozzle clogging. A high pressure pump is used to pressurize the dispersion to between 100 and 1500 psi. It is noted that a standard air driven piston pump can cause momentary interruptions in sprays as the pump shifts strokes, which could lead to uneven distribution of the polymer dispersion. This problem can be eliminated with appropriately designed fluid circuits using constant pressure pumps or surge chambers, and/or fluid regulators.

Pre-atomization may optionally be used in the present invention. Pre-atomization essentially involves the generation of turbulence within the polymer dispersion prior to entering the nozzle, which can assist in optimizing atomization.

The aqueous polymer dispersion may include any polymer or a mixture of polymers known in the art, and can be made by means known in the art. Polymers useful in the present invention include both natural and synthetic polymers; and homopolymers, copolymers, block polymers, multi-stage polymers, and star polymers. Examples of useful polymer chemistries include, but are not limited to, ethylene vinyl acetate polymers, acrylic homopolymers and copolymers, vinyl acetate homopolymers, starches, cellulosics, all with and without cross-linking capability.

Stabilization of such dispersions can be achieved using a wide variety of chemical species, including low molecular weight emulsifying agents, such as anionic, nonionic, cationic, and amphoteric surfactants; high molecular weight protective colloids, such as polyvinyl alcohol, cellulosics, dextrines and starches; or a combination thereof. The polymer may be functionalized to improve performance characteristics after it is applied to the substrate. This includes cross-linking and self-cross-linking functionality, and the range of fully redispersible polymer dispersions to water repellent hydrophobic polymer dispersions. Preferably, the dispersion is not excessively thixotropic in behavior when used with a cross cut nozzle. Polymer dispersions having Newtonian flow characteristics can be used with dome nozzles without preatomization.

The key parameters of the dispersion are the viscosity and solids level. The solids level is preferably maximized to reduce the amount of water that must be removed following application. The viscosity dictates the degree of atomization. Useful viscosities are from 10 to 5,000 m·Pas, and preferably 100 to 2,000 m·Pas at the temperature of application. Optimum atomization is obtained using dispersions having a viscosity of from 100 to 2000 m·Pas. Dispersions with viscosities in excess of 2000 m·Pas can be used with the airless spray system, but require additional air pressure and possible warming. The viscosity of the dispersion must be within a range that can be handled by the airless spray equipment. Warming the dispersion to temperatures up to 90° C., preferably to a temperature of 20° C. to 70° C., and most preferably to a temperature between 40° C. and 60° C. provides for the use of higher solids content without exceeding viscosity limitations. The use of heated polymer dispersions offers exceptional control of polymer positioning down to very low add-on levels with a minimum of overspray. Add-on levels of 3 grams per square meter and lower can be achieved. The viscosity level is irrespective of the non-volatile content.

Polymer dispersions having any non-volatile level may be used in the present invention, provided the polymer dispersion is within the defined viscosity limits. Airless spray technology allows dispersions to be sprayed at higher solids levels than conventional spray techniques. Most commercial polymer dispersions, having solids level of from 40 to 70 percent, may be used without the need for dilution.

Other polymer parameters may be adjusted, as known in the art, to achieve the desired enduse properties. The molecular weight and Tg of the polymer can be varied as desired. Cross-linking and self-cross-linking functionality may be added to the polymer. The hydrophobicity/hydrophilicity of the polymer may be adjusted to achieve the desired level of water resistance.

The polymer dispersion may contain other components, including fillers, whitening and opacity agents, odor control agents such as zeolites, slow release fragrances, flame retardants, and antimicrobial agents.

In one preferred embodiment, titanium dioxide is associated with the dispersion. It is advantageous to apply the titanium dioxide at as high a solids level as possible, and the present invention allows for high solids application. The titanium dioxide is combined with the polymer dispersion at a level of from 5 to 40 percent based on the polymer solids content of the dispersion. The titanium dioxide is stabilized in the dispersion by means known in the art, such as through the use of colloids (including cellulosics), and/or surfactants. Preferably the titanium dioxide will have a particle size of between 0.1 microns and 2.5 microns, most preferably 0.15 to 0.5 microns. The polymer/titanium dioxide dispersion is then sprayed onto a non-woven material using the airless spray technique of the present invention. This process has the advantage of placing titanium dioxide onto the surface of the non-woven where it is most useful, and binding it to the non-woven by the polymer in a manner which prevents its release, or dusting.

The process of the present invention allows for the delivery of the polymer dispersion precisely where needed—either in a complete fiber covering operation, on the surface, or other location. Since a higher-solids dispersion can be used in an airless spray process, a through and through process requires less drying time—thereby improving line efficiency. The main advantage of the present process is the ability to selectively apply a polymer dispersion on a substrate surface. Distribution of the polymer dispersion into the core of a non-woven can be controlled by systematically diluting the dispersion with water.

The process of the present invention can be used in any application in which a polymer dispersion is optimally applied in a precise manner. The process is useful on any known substrate. Because the polymer dispersion can be sprayed at a high solids level, the process is particularly useful with porous material where a surface-only application is desired. Since the polymer dispersion can be sprayed at higher solids level and viscosity, penetration of the substrate can be minimized—resulting in the use of less polymer, and requiring less time, energy, and expense in drying. Porous materials for which the process is useful include wood, leather, fabrics, textiles, paper, tissue, wadding, and especially non-woven materials. Airless spray is also useful in the preparation of laminate structures, typically being constructed from a variety of porous and non porous substrates (e.g. polyethylene) laminated together with accurately applied layers of polymer dispersion between the various components.

The process of the present invention is useful for forming non-woven materials that typically require consolidation, or the inclusion of binder within the configuration to control dusting or effect specialized surface treatments. The non-woven material may include top-sheets, backing, wipes, tabletop articles (e.g. serviettes), fiber-fill, structures used in hygiene products, and wadding. In a wadding operation, it is desirable to have bonding only at the surface. The wadding process often uses a thermal bonding process, which can be performed at relatively high line speed. Conventional polymer resin-binding operations tend to be slower, since water must be evaporated to form the bond, and since conventional spray techniques cannot precisely apply the binder only to the surface without also going through the surface and into the wadding material. This wastes binder, and requires extra drying time. The process of the present invention allows for faster line speed in a resin-bonded operation, since the binder can be applied only to the surface where it is needed, and can be applied at a higher solids content—requiring less time and expense for evaporation of water.

A Resin Bonded Airlaid (RBAL) application, typically consists of fluff pulp consolidated with a water based polymer dispersion (e.g. self cross-linking copolymers of Vinyl Acetate Ethylene) in ratios of dry binder to pulp ranging from 5:95 to 40:60, including any combinations between these specified ranges. The binder is applied in the wet state using airless spray technology, with the dispersion being diluted to about 15 percent non volatile content prior to application to assist in the homogenous distribution of binder throughout the fibre matrix. Representative web grammage produced in the bonded nonwoven could vary between 30 and 300 grammes per square meter (gsm).

In a Multi Bonded Airlaid (MBAL) application, the binder is primarily used to control linting (dusting) in the final article . The polymer dispersion would be applied to the web at a non volatile content of 30 weight percent using airless spray to position the binder primarily on the web surface with marginal penetration into the core. The web typically used would consist of fluff pulp plus low melting bicomponent fibres and binder applied on both surfaces. The components could vary according to the following illustrative ratios depending on the grammage of the final product: a) Pulp: Bicomponent: Binder (70:25:5) in an 80 gsm configuration; b) Pulp: Bicomponent: Binder (86:10:4) in a 250 gsm configuration.

A polymer dispersion can be surface coated onto a non-woven web, the web consisting of either purely synthetic fibres, natural fibres, or a combination of both. The binder would be applied to the surface using airless spray technology with the dispersion used as supplied (without dilution), typically about 50 percent non volatile. This limits penetration of the binder into the core, producing in effect a surface coating. The binders used could any polymers known in the art and may have added functionality e.g. antimicrobial, very hydrophilic and very hydrophobic types. The latter two examples of which could be applied on alternate sides of the web in the control of fluid management.

The following examples are presented to further illustrate and explain the present invention and should not be taken as limiting in any regard.

EXAMPLE 1

(Comparative)

Multi Bonded Airlaid Configuration

VINAMUL 3236 (Vinamul Polymers), a non-cross-linking, polyvinyl alcohol stabilized ethylene/vinyl acetate emulsion having a Tg of −18° C. and a solids content of 59 percent and a viscosity of 9600 m·Pas, was sprayed onto a thermally Bonded Airlaid non-woven substrate using a NORDSON airless spray at a pressure of 1000 Psi, with a cross-cut nozzle delivering 527 ml/minute of latex. No atomization occurred.

EXAMPLE 2

Example 1 was repeated using the VINAMUL 3236 emulsion diluted to 51.3 percent solids, and having a viscosity of 2900 m·Pas using a Dome nozzle delivering 527 ml of latex per minute. This produced atomization but with a narrow spread.

EXAMPLE 3

Example 1 was repeated using VINAMUL 3236 diluted to 49.2 percent solids and having a viscosity of 2100 m·Pas using a Cross-cut nozzle delivering 72 ml of latex per minute at a pressure of 800 PSI. This resulted in good atomization but narrow spread.

EXAMPLE 4

Example 1 was repeated using VINAMUL 3236 diluted to 47.0 percent solids and having a viscosity of 1900 m·Pas using a Cross-cut nozzle delivering 527 ml of latex per minute. This produced good atomization and spread.

EXAMPLE 5

Example 1 was repeated using DUR-O-SET ELITE 20 (National Starch and Chemical), a very low formaldehyde, hydrophilic, self-crosslinking ethylene/vinyl acetate polymer dispersion having a Tg of 0° C., a solids level of 50.0 percent, and a viscosity of 400 m·Pas. Good atomization and a good spread were produced.

EXAMPLE 6

Example 1 was repeated using DUR-O-SET ELITE 20 at a solids content of 50 percent with a viscosity of 400 m·Pas, using a Dome nozzle with a pre-atomization device delivering 527 ml of latex per minute at a pressure of 700 PSI. This combination produced good atomization but marginally narrower spread than Example 5.

What is claimed is:

1. A method for applying an aqueous polymer dispersion to a substrate comprising:

a) forming an aqueous polymer dispersion having a solids level of from 40 to 70 weight percent and comprising from 30 to 60 percent by weight of water, wherein said aqueous polymer dispersion has a viscosity of from 10 to 5,000 m·Pas at the temperature at which it will be applied;

b) applying said dispersion to a substrate at a pressure of from 100 to 1500 psi, by means of an airless spray.

2. The method of claim 1 wherein the substrate is a porous substrate.

3. The method of claim 2 wherein said substrate is a non-woven material.

4. The method of claim 1 wherein the viscosity of the polymer dispersion is from 100 to 2,000 m·Pas.

5. The method of claim 1 wherein the polymer dispersion is applied to said substrate at a temperature of from 20° C. to 90° C.

6. The method of claim 5, wherein the polymer dispersion is applied to said substrate at a temperature of from 40° C. to 60° C.

7. The method of claim 1 wherein said polymer dispersion comprises at least one polymer selected from the group consisting of ethylene vinyl acetate polymers, acrylic homopolymers and copolymers, or vinyl acetate homopolymers.

8. The method of claim 1 wherein said polymer dispersion comprises a polymer selected from the group consisting of starches, cellulosics or mixtures thereof.

9. The method of claim 1 wherein the polymer dispersion further comprises fillers, opacity agents, whitening agents, or mixtures thereof.

10. The method of claim 9 wherein said opacity agent and said whitening agent comprise titanium dioxide.

* * * * *